United States Patent [19]

Frantello

[11] 4,208,799

[45] Jun. 24, 1980

[54] INCH GAUGE

[76] Inventor: Donald Frantello, 405 SE. 7th Ave., Deerfield Beach, Fla. 33441

[21] Appl. No.: 726,536

[22] Filed: Sep. 27, 1976

[51] Int. Cl.[2] ..... G01B 3/30

[52] U.S. Cl. ..... 33/187; 33/41 F

[58] Field of Search ..... 33/187, 188, 174 G, 33/82, 41 F

[56] References Cited

U.S. PATENT DOCUMENTS 3,516,167 6/1970 McCain, Jr. ..... 33/41 F

*Primary Examiner*—Willis Little

*Attorney, Agent, or Firm*—Robert D. Farkas

[57] ABSTRACT

A siding gauge that enables one man to install prime board siding or other type where a one inch or predetermined measure overlap is required and the siding must be level; the gauge comprises a pair of J shaped members joined base to base, one inverted relative to the other.

6 Claims, 4 Drawing Figures

INCH GAUGE

BACKGROUND OF THE INVENTION

This invention relates to a siding gauge; more particularly to one that enables one man, if desired to both properly space and provide for level alignment of the siding while at the same time enabling him to nail the same up.

The prior art teaches a variety of siding gauges, and the like, for example as disclosed in U.S. Pat. Nos. 325,811; 421,746; 445,681; 652,256; 774,114; 3,133,357; 3,463,480; 3,518,770; and others.

SUMMARY OF THE INVENTION

It is accordingly an object of the instant invention to provide for a new and improved siding gauge.

It is another object to provide for the same which has the aforementioned attributes.

It is a further object to provide for the same at relatively little cost thereby making the same generally available.

These and other objects and advantages of the invention will become more apparent from a consideration of the following detailed disclosure and claims and by reference to the accompanying drawings, in which:

Figure 1:
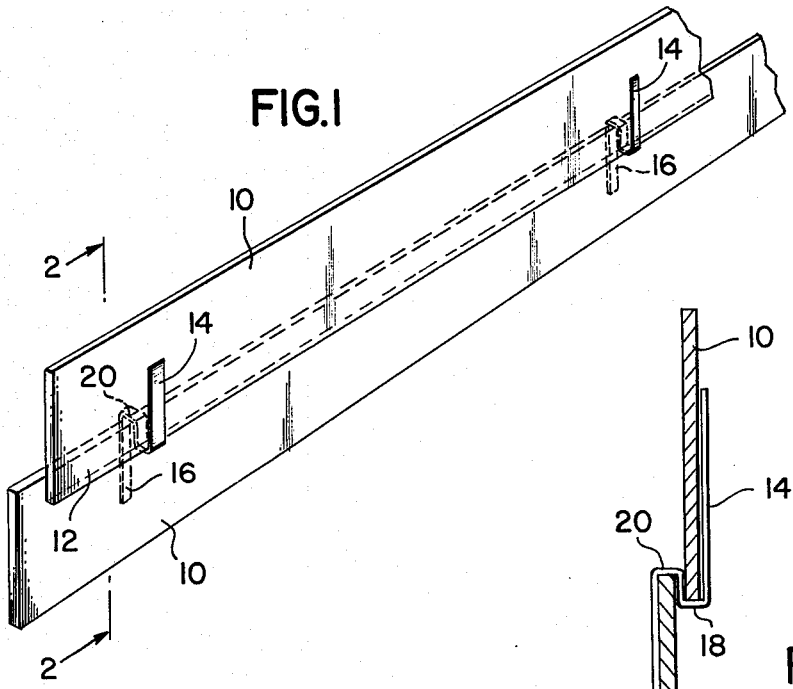
FIG. 1 is a perspective view.
Figure 2:
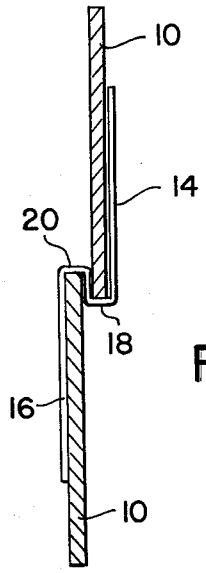
FIGS. 2 and 4 are side elevational views.
Figure 3:
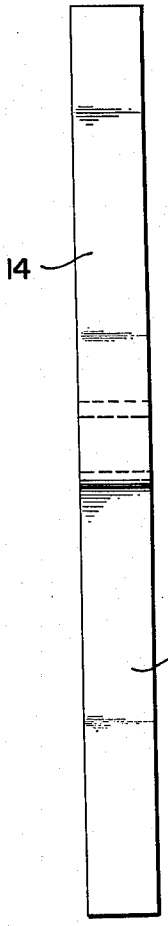
FIG. 3 is a front elevational view.
Figure 4:
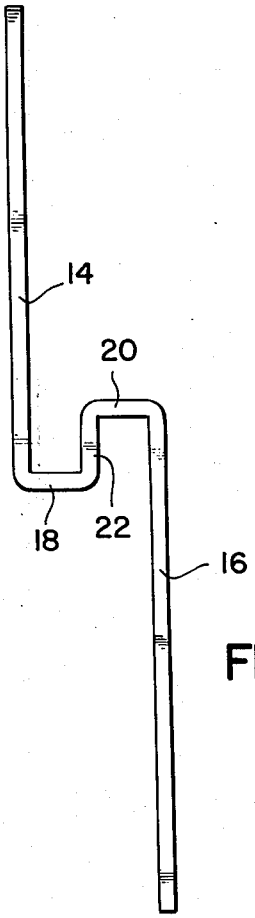

Broadly speaking, the instant invention includes the provision of a device for use in conjunction with the mounting wall building of siding, comprising a pair of parallel spaced apart, vertically aligned first members, a pair of horizontally aligned, parallel second members perpendicular to the first members, the second members in spaced apart relation and disposed out of planar alignment, a third member communicating between the second members and being vertically disposed relative thereto.

DETAILED DISCLOSURE

Referring more particularly to the drawings, there is shown siding boards 10 that are generally ⅜" thick, 12" wide and 16' long, wherein a one inch overlap 12 between boards 10 is required in the hanging of the same prior to the nailing of the same in place. The instant device enables one to both properly align and distance the boards 10 one from the other. The device is generally constructed of a rigid metal or plastic material that comprises a pair of generally J shaped members joined at their bases with one being inverted relative to the other. The device forms two parallel and opposing vertically disposed members 14, 16 that are about 9" or longer in length, respectively. Each member 14 or 16 communicates with a second member or shoulder 18, 20 that is perpendicular thereto and horizontally disposed and is about 1-1½" in length. The is thus formed a pair of L shaped members, one inverted and turned backward relative to the other. A thrid member 22 communicates therebetween and is vertically disposed relative to the two second members 18, 20. The third member 22 is about 3¼" in length. As such, there is formed internal openings of about one inch between members 14 and 22 and 16 and 22, respectively. In the preferred embodiment, the entire unit is of unitary construction and thereby provides for ease of installation of the siding.

Since it is obvious that numerous changes and modifications can be made in the above-described details without departing from the spirit and nature of the invention it is to be understood that all such changes and modifications are included within the scope of the invention.

I claim:

1. A device for use in conjunction with the mounting of wall building siding, comprising a unitary apparatus including a pair of parallel spaced apart vertically aligned elongated first members, a pair of horizontally aligned parallel elongated second members, said second members disposed perpendicular to said first members and fixedly secured thereto, each of said second members disposed in spaced apart relationship and disposed out of planar alignment with each other, a third elongated member fixedly secured to and in between said second members and being vertically disposed relative thereto, wherein one of said first members and one of said second members and one surface of said third member define a first cavity, another of said first members and the other surface of said third member and the other of said second members defining a second cavity, said first and said second cavities being out of planar alignment with one another and being partially juxtaposed relative to one another.

2. The device as defined in claim 1 wherein said first and said second cavities are juxtaposed about one inch.

3. The device as defined in claim 1 wherein said first members are at least about nine inches in length.

4. The device as defined in claim 1 wherein said third member is parallel to said pair of first members.

5. The device as defined in claim 1 wherein said third member is about 3 to 3½ inches in length.

6. The device as defined in claim 1 wherein said first said second and said third members are formed from steel.

* * * * *